United States Patent [19]

Balz

[11] 4,012,869

[45] Mar. 22, 1977

[54] RECIPROCAL FINISHING APPARATUS

[75] Inventor: Gunther W. Balz, Kalamazoo, Mich.

[73] Assignee: Roto-Finish Company, Kalamazoo, Mich.

[22] Filed: May 2, 1975

[21] Appl. No.: 573,906

[52] U.S. Cl. ..... 51/163.2

[51] Int. Cl.[2] ..... B24B 31/06

[58] Field of Search ..... 51/7, 163

[56] References Cited

UNITED STATES PATENTS

| | | | |
|---|---|---|---|
| 3,422,577 | 1/1969 | McKibben | 51/163 R |
| 3,423,884 | 1/1969 | Balz | 51/163 R |
| 3,464,163 | 9/1969 | Ferrara | 51/163 R |
| 3,611,638 | 10/1971 | Deede | 51/163 R |
| 3,792,552 | 2/1974 | Isaacson | 51/163 R |

FOREIGN PATENTS OR APPLICATIONS

| | | | |
|---|---|---|---|
| 959,849 | 6/1964 | United Kingdom | 51/163 |

*Primary Examiner*—Harold D. Whitehead
*Attorney, Agent, or Firm*—Gordon W. Hueschen

[57] ABSTRACT

A machine for finishing parts, having part-isolating means such as vertical partitions or dividers, defining one or more compartments, disposed at least partially within the finishing chamber, each compartment designed to accept a part or parts to be finished and to maintain the parts isolated from each other. The finishing chamber and the part-isolating means are reciprocally movable with respect to each other first for a limited distance in a forward direction, and then for a limited distance in a rearward direction generally of the same magnitude. During movement in the forward direction the partitions are disposed intermediate the parts. At the end of the limited forward distance the partitions are removed from their positions intermediate the parts and remain in said removed positions during the rearward movement. At the end of the rearward movement for said limited distance the partitions are returned to their positions intermediate the parts and are ready to begin a succeeding cycle.

13 Claims, 9 Drawing Figures

SLOW
FAST
TO SUMP
FROM PUMP

Fig. 6
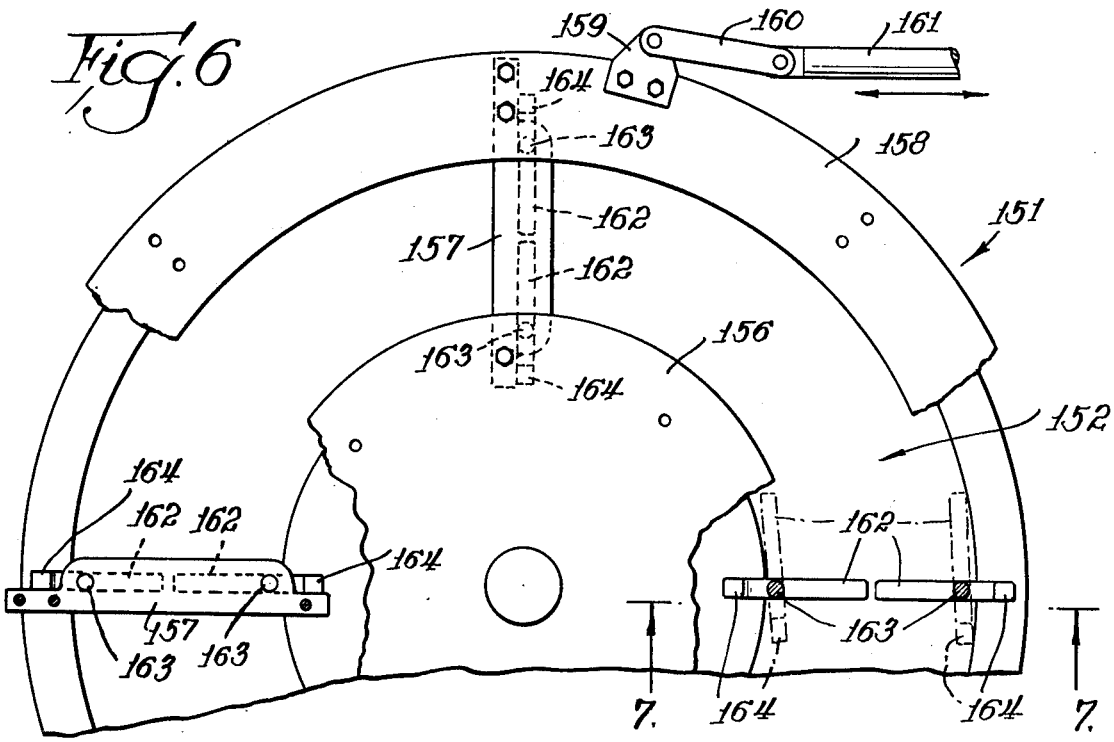
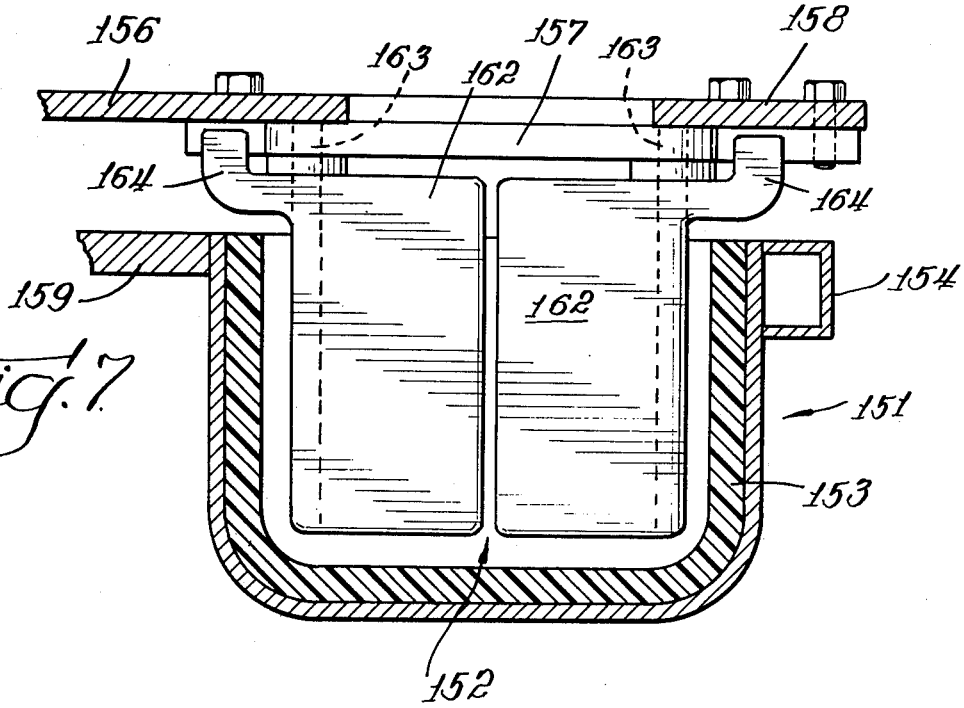
Fig. 7

170
171
172
173
174
175
176
177
178
179
180
181
182
183
184
185
186
187
188
189
190
191
192
193
194
195
196
197
198

200
201
202
203
204
205
206
207
208
209
210
211
212
213
214
215
216
217
218
219
220
221
222
223
224
225
226

RECIPROCAL FINISHING APPARATUS

BACKGROUND OF THE INVENTION

1. Field of Invention

The present invention relates to finishing machines, being especially adapted for use in or with vibratory finishing machines and particularly those having a curvilinear finishing chamber and vertically oriented gyratory motion-producing assembly and power driving means.

2. Prior Art

Finishing machines and especially vibratory finishing machines are well known in the art. Such machines are used for various forms of finishing, such as burr removal, burnishing, and polishing. Such machines are disclosed and claimed in U.S. Pat. Nos. Re. 27,084, 3,400,495, 3,423,884, 3,435,564, 3,466,815, 3,606,702, and 3,633,321. Machines of the type described generally have a finishing chamber and a motor operatively mounted with respect to the chamber and arranged to cause eccentric weights to rotate or revolve, thereby producing vibratory motion of the finishing chamber. In one form disclosed in the prior art, a tub-type of finishing chamber, usually linear, has a motor with eccentric weights mounted on the shaft of the motor directly mounted to the tub, or a shaft with eccentric weights mounted to the tub and motor driven. In another type, the eccentric weights are mounted out of phase on a vertical shaft, causing the finishing chamber which is generally curvilinear to undergo gyratory motion. In either type, as a result of the vibratory movement, when materials such as parts and/or finishing materials are placed in the chamber, orbital motion is imparted to the contents so that they move upwardly at the peripheral portion of the chamber and downwardly at the inner portion of the chamber. This results in relative movement between the finishing material and parts, or at least interaction therebetween, causing the parts to be finished. Additionally, in the gyratory-type of finishing machine, by employment of a proper phase relationship between the eccentric or unbalance weights, varying degrees of precession or linear progression of the material and parts are caused circumferentially around the annular finishing chamber, as is well-known in the art. Various forms of guides or vanes, including helical guides, have also been fixed internally of a finishing chamber to assist with such precession. See, for example, U.S. Pat. No. 3,071,900.

Prior art finishing machines, e.g., tumbling machines and vibratory finishing machines, such as described above, generally function well. However, they all suffer from at least one disadvantage. During the finishing process, there is a tendency for closely adjacent parts to collide with each other as a result of the tumbling or vibrational movement imparted to them, often resulting in considerable damage to the parts by denting or fracture. In U.S. Pat. No. 3,423,884, a finishing apparatus is disclosed wherein the entire finishing machine may be mounted for rotation by an adjoining motor and belt assembly. The finishing chamber is divided into a plurality of compartments which are stationary with respect to the finishing chamber, the entire assembly if desired rotating during the finishing process. This apparatus succeeds in isolating high precision and easily damageable parts so that they are safely finished. However, no unloading means have been provided or suggested for such machine and it is necessary that each part be unloaded by hand. The cost of labor utilized in manually loading of parts, separating parts from finishing media, and hand removal of finished parts from the finishing machine is extremely high, if not prohibitive. Finishing machines have also been devised utilizing spindles, wherein the parts are fixtured to a spindle during the finishing process. The cost of manually mounting the parts and removing them in such devices is also prohibitively high. Floating compartment devices are also known, but these are no better than fixed compartment machines and suffer from the same disadvantages as previously noted, e.g., the necessity of manual loading and separation and the high cost of labor associated therewith in the absence of any suggestion of automatic separation and how it might be effected in such devices.

As known in the art, parts-finishing cycle control or adjustment has been effected by controlling the phase relationship of the eccentric weights on the shaft driven by the motor. U.S. Pat. Nos. 3,435,564 and 3,466,815 show means for making such adjustment. This is a partially satisfactory way of operation, but it has the limitations that it does not permit precise or exact control of the parts-finishing cycle, and further, that it does not keep the parts evenly distributed in the finishing chamber. The method and apparatus of the present invention, on the other hand, does permit precise and exact control of the parts-finishing cycle, and does permit isolation of parts from other parts to prevent damage to the parts as a result of collision between them.

In copending application Ser. No. 414,656 of this inventor, a novel finishing apparatus is disclosed and claimed having partition means movable with respect to the finishing chamber to define compartments for isolating a part or parts. This apparatus has been found to be eminently successful in preventing damage to parts as a result of collision. The present apparatus is an improvement on the apparatus of the copending application in that it provides a reciprocating means for moving the partitions with respect to the chamber and with respect to the parts which permits simplification of the partition moving apparatus. The present apparatus and method are also improvements on the disclosure of British specification No. 959,849 in many ways, as will become apparent hereinafter.

OBJECTS OF THE INVENTION

It is accordingly an object of the present invention to provide a finishing apparatus wherein parts-isolating means are provided for maintaining parts, which are particularly subject to damage by collision with adjacent parts isolated from other parts. It is an additional object to provide a finishing apparatus of the type described wherein the parts to be finished are permitted to move with respect to the chamber while still maintaining parts isolated from other parts. It is still an additional object to provide such an apparatus having means for automatically discharging the parts from the finishing chamber when the parts have been sufficiently finished. It is still another object to provide an apparatus for finishing parts while maintaining them isolated from other parts, which can utilize any of the commonly utilized methods of finishing parts. It is another object to provide means for maintaining parts in isolated condition during the finishing process, which apparatus can be readily adapted to existing conventional finishing apparatus. It is an additional object to provide a means for exact control of the finishing cycle by controlling the speed of the moving parts, which permits exact timing of part entry, part exit, and time during which the parts remain in the machine during the finishing cycle, whereby the timing cycle can be so precisely controlled that the process may be synchronized to other machines operated in conjunction with the finishing machine. It is another object to provide a finishing machine of the type described in which the part-isolating means and finishing chamber move with respect to each other and whereby the finished parts are automatically separated, if desired after a precisely timed finishing cycle, and if desired with automatic return of separated finishing material to the finishing chamber for reuse. It is still another object to provide a finishing machine of the type described which embodies part-isolating means which move vertically with respect to the finishing chamber, for changing the boundaries of compartments therein. It is another object to provide apparatus for finishing parts in which parts are isolated from other parts during the finishing process, finished parts are preferably automatically separated, and whereby the finishing cycle may be precisely controlled if desired, optionally by creating moving boundary compartments in the finishing chamber. It is a primary object of the invention to provide a finishing machine of the type described in which the partitions which define the isolating compartments are moved in reciprocating motion, thereby simplifying the apparatus required to provide part separation. Still other objects will readily present themselves to one skilled in the art upon reference to the ensuing specification, the drawings, and the claims.

BRIEF DESCRIPTION OF THE DRAWINGS

In the drawings,

FIG. 6 is a fragmentary top plan view of another embodiment of the invention.

FIG. 7 is a fragmentary sectional view taken at the line 7—7 of FIG. 6, looking in the direction of the arrows.

DESCRIPTION OF THE PREFERRED EMBODIMENTS

Figure 1:
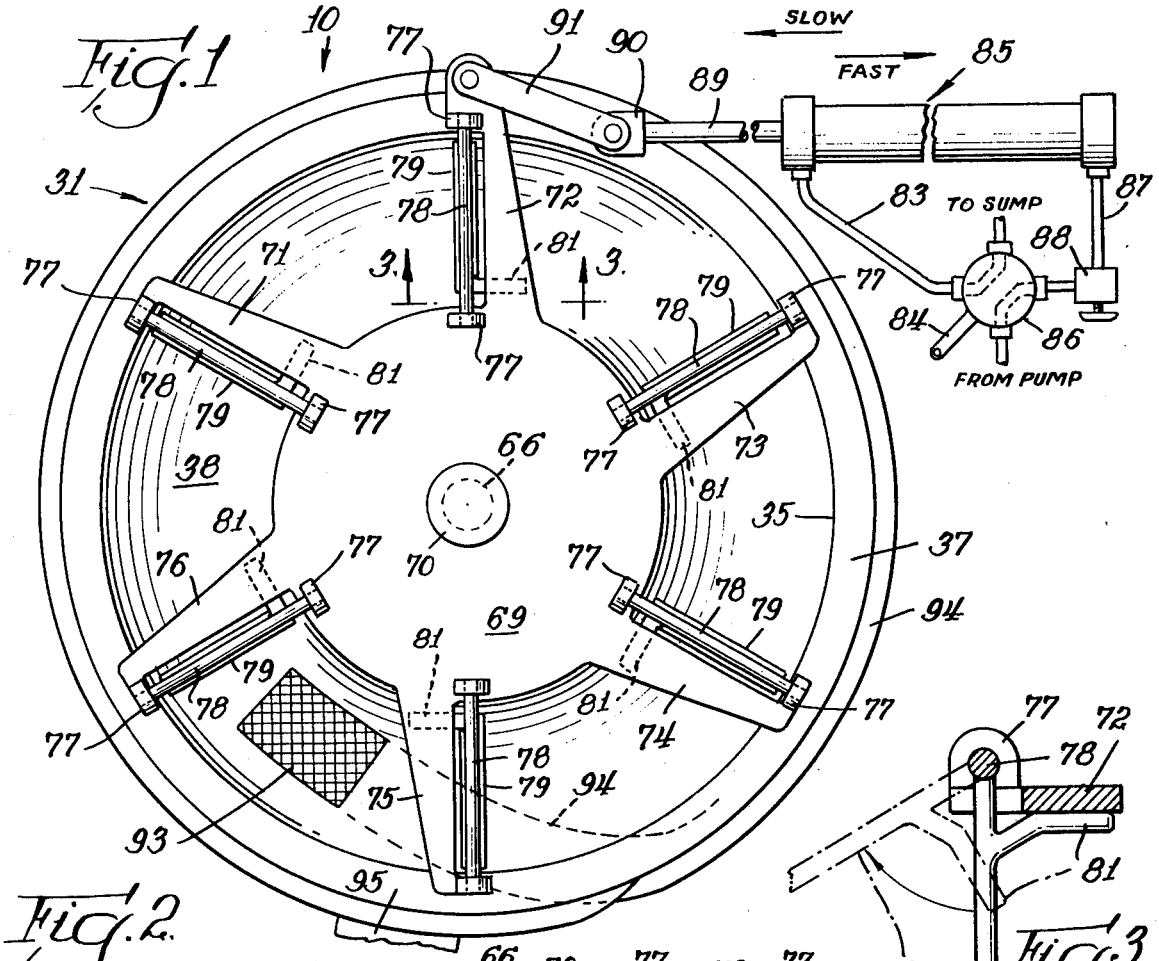
FIG. 1 is a top plan view of a finishing machine according to the invention.
Figure 2:
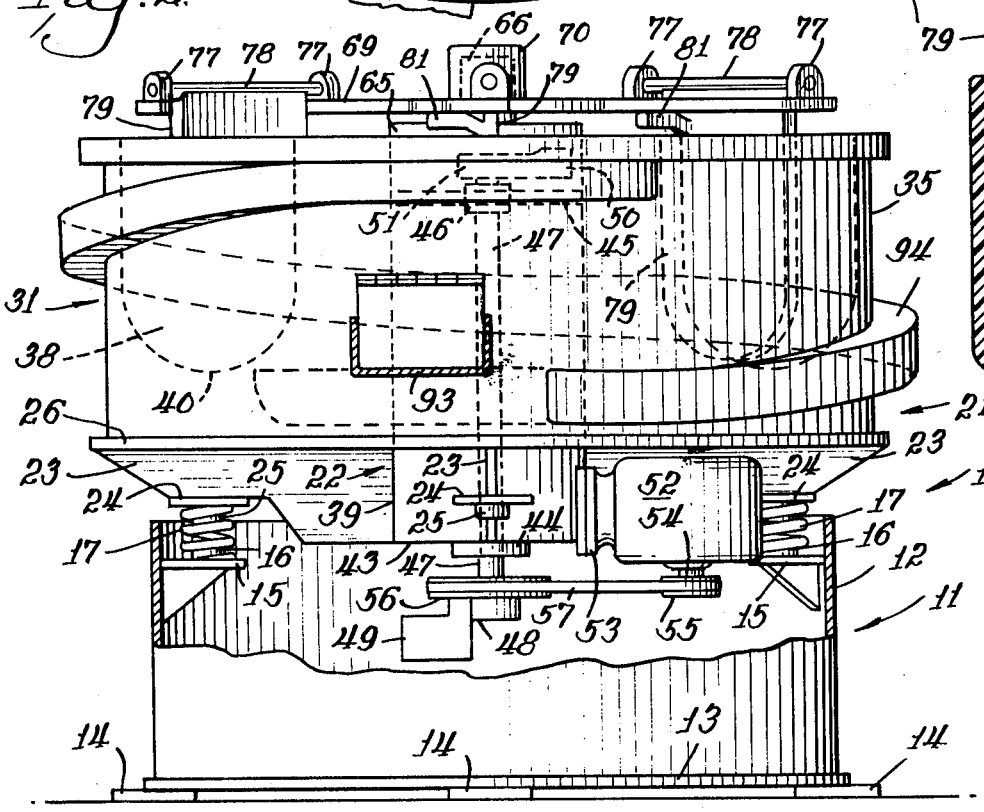
FIG. 2 is an elevational view partly in cross-section of the finishing machine shown in FIG. 1.
Figure 3:
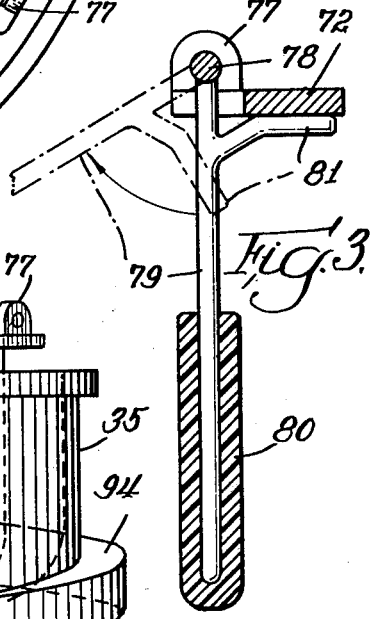
FIG. 3 is a fragmentary sectional view taken at the line 3—3 of FIG. 1, looking in the direction of the arrows.

Referring to FIGS. 1–3, a vibratory finishing apparatus 10 is shown comprising a fixed base 11 having a cylindrical wall 12, a bottom 13, square foot plates 14, and a radially directed annular flange 15. The spring-engaging protuberances 16 are affixed to the flange 15 for engaging one end of coil springs 17. Alternatively, a resilient material such as rubber or other elastic materials may be utilized in place of coil springs.

A floating supporting assembly 21 comprises a central tubular gyratory motion-producing assembly 22 and sheetform radial supports 23. The radial supports 23 have square plates 24 affixed thereto on one edge which are provided with spring-engaging protuberances 25 on the other surfaces of the plates which engage the upper ends of the coil springs 17. Horizontal radial supporting arms 26 are affixed to the radial supports 23 by means such as welding. The radial supports 23 and the radial supporting arms 26 are welded to each other and to the central tube assembly 22.

Mounted on the floating support assembly 21 is an annular finishing chamber or tub assembly 31 having an outer tubular wall 35, having a rim 37 and supporting an annular finishing chamber 38 disposed therein and affixed thereto by welding.

The central gyratory motion-producing assembly 22 comprises a vertically oriented tubular housing 39 affixed by welding at a lower portion thereof to the radial supports 23. The annular finishing chamber 38 may be in any of a large number of different sizes and shapes. The chamber shown in FIGS. 1 – 3 has an arcuate bottom 40 and is in the form of a single turn annulus or ring, having a discharge zone in one portion and a loading zone in another.

Mounted in the lower portion of the tubular housing 39 are a lower bearing support plate 43 having a bearing 44 mounted thereon, and an upper bearing plate 45 having a bearing 46 mounted thereon. An eccentric weight-supporting shaft 47 is rotatably journaled in the bearings 44 and 46, and has a lower arm 48 affixed to the end thereof supporting an eccentric or unbalance weight 49. An upper eccentric or unbalance weight 50 is mounted at the other end of the shaft 47 on an arm 51 affixed to the shaft.

A motor 52 is mounted on a mounting plate 53 on the outer surface of the tubular housing 39 at the lower end thereof. The motor shaft 54 has a pulley 55 affixed thereto which is operatively connected to a pulley 56 mounted on the shaft 47 by means of an endless flexible belt 57.

The structure for defining compartments movable in reciprocating motion with respect to the finishing chamber is shown in FIGS. 1 – 3. The structure comprises a pedestal 65 mounted on the cylindrical support 39 and having a vertical spindle 66 with a turntable 69 rotatably mounted thereover by means of a bearing. A cap 70 affixed to the turntable covers the bearing. Radial arms 71, 72, 73, 74, 75, and 76 are connected to the turntable 69. A plurality of trunnion members 77 are mounted on the radial arms 71 – 76 and have shafts 78 rotatably journaled through apertures provided in the trunnion members. Partitions or separators 79 are mounted on the shaft 78. As shown in FIG. 3, the partitions have rubber or plastic sheaths 80 and are free to swing in a forward direction. Restraining arms 81 are affixed to the partitions and are arranged to engage the radial arms 71–76 and thereby to prevent the partitions from swinging in a rearward direction beyond the vertical position.

Power for reciprocating the partition assembly is provided by means of a hydraulic power assembly comprising a hydraulic cylinder 85 having a control valve 86 operated by a control arm 84 connected to a timing control (not shown). The valve 86 is connected to ports on the hydraulic cylinder by means of ducts 83 and 87, with a metering valve 88 inserted in series with the ducting system to control the speed of operation. A piston rod 89 is connected to a piston (not shown) in the hydraulic cylinder 85. The other end of the piston rod 89 is hingedly connected by means of a clevis 90 to a connecting rod 91 which in turn is connected by a hinge pin to the radial arm 72.

As shown in FIGS. 1 and 2, in order to separate finishing material from the parts and discharge the parts, a foraminous separation member or screen 93 is provided in the bottom of the finishing chamber 38 which permits the finishing material to pass therethrough but restrains the parts as they pass thereover. The finishing material drops to the bottom of a helical duct 94, and as the gyrational motion of the finishing machine proceeds, the finishing material rises along the duct until the top thereof from which it is conducted back into the annular trough to begin a new cycle. The parts are discharged through a discharge duct 95.

In placing the embodiment of FIGS. 1–3 into operation, the usual loose, aggregate type of finishing material, e.g., resin-bonded, ceramic, rock fragments, cob meal, or the like, is loaded into the finishing chamber 38. The parts are then loaded into the finishing chamber, one or more parts being placed in each compartment intermediate each pair of partitions 79. The electric motor 52 is then activated, causing the finishing chamber to undergo a gyratory motion, thereby causing the parts and finishing material to engage in orbital motion in the arcuate chamber, and additionally to undergo precession in the circumferential direction along the trough of the finishing chamber. Motion of the turntable 69, radial arms 71–76, and partitions 79 is controlled by the hydraulic system, and may be timed to proceed passively at the speed of precession of the parts, which is greatly preferred, or may, if desired, be timed to be greater or less than the normal speed of precession of the parts, frequently less for purposes of retarding their normal rate of precession and thereby ensuring adequate finishing in a single pass through the machine. When the assembly has moved in a forward direction with respect to the finishing chamber for a predetermined distance, the valve 86 is reversed and the piston rod 89 caused to move in the reverse direction, thereby moving the assembly in a reverse direction. During the forward motion, the partitions maintain each part separated from every other part, thereby preventing damage by collision. At the end of the forward travel, the hydraulic cylinder reverses and the assembly supporting the partitions moves in a rearward direction. As the partitions encounter the parts and finishing media, they pivot and ride over the parts, leaving their position intermediate the parts. At the end of the rearward movement, the hydraulic cylinder again reverses and begins to move or to permit the partition assembly to move forward again. The partitions are then permitted to pivot downward as they encounter the parts and remain in vertical position to once again separate the parts when the restraining arms 81 engage the surfaces of the radial arms 71–76. The rearward motion portion of the cycle may be speeded up so that the period of time during which the partitions are not intermediate the parts is made as short as possible. Alternatively, instead of permitting the partitions to ride over the parts in order to remove them from their positions intermediate the parts, mechanical means such as gear movements or rotary solenoids may be utilized to pivot the partitions mechanically at the desired time to remove them from the positions intermediate the parts and to restore them to such positions, the entire cycle being controlled by a timing device. Ultimately, each part and its accompanying finishing material reaches the separation screen 93, the finishing material falling through the screen to the duct 94 which returns the finishing material to the starting position, and the parts being discharged through the part discharge duct 95.

Figure 4:
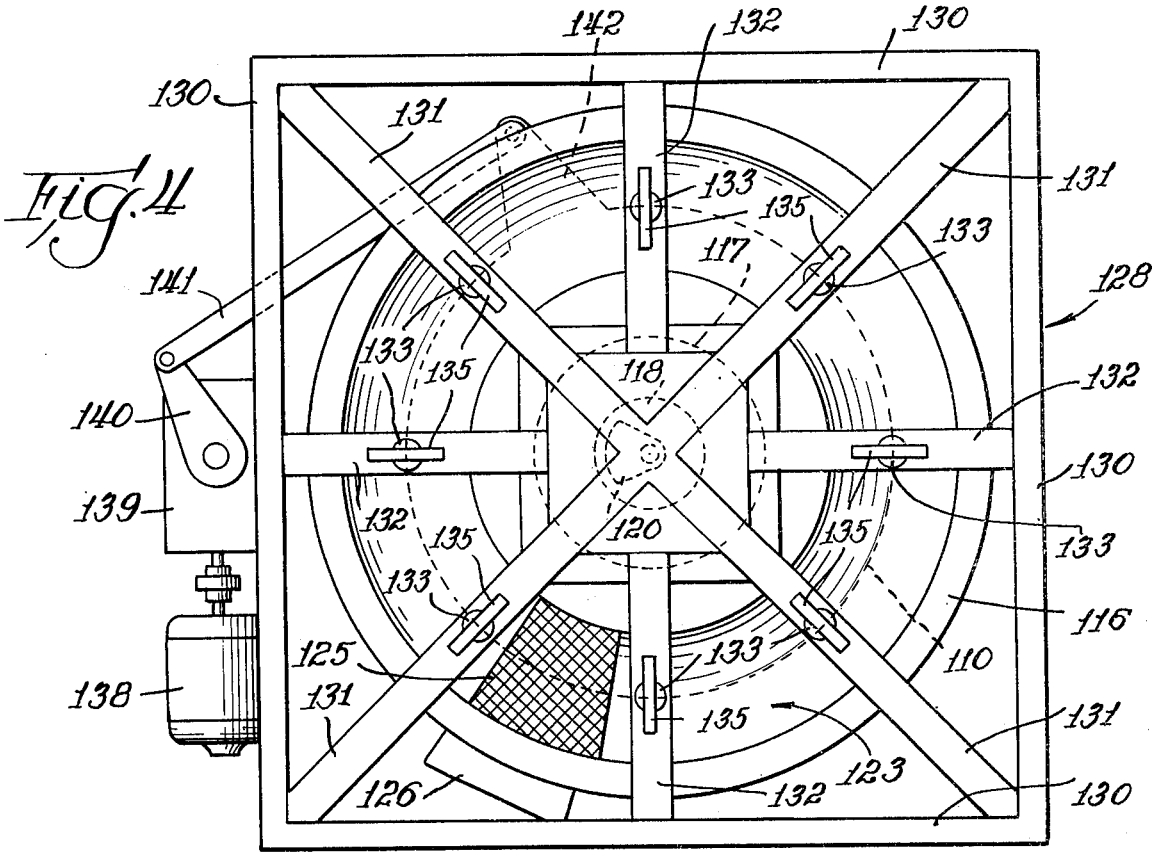
FIG. 4 is a top plan view of another embodiment of the invention.
Figure 5:
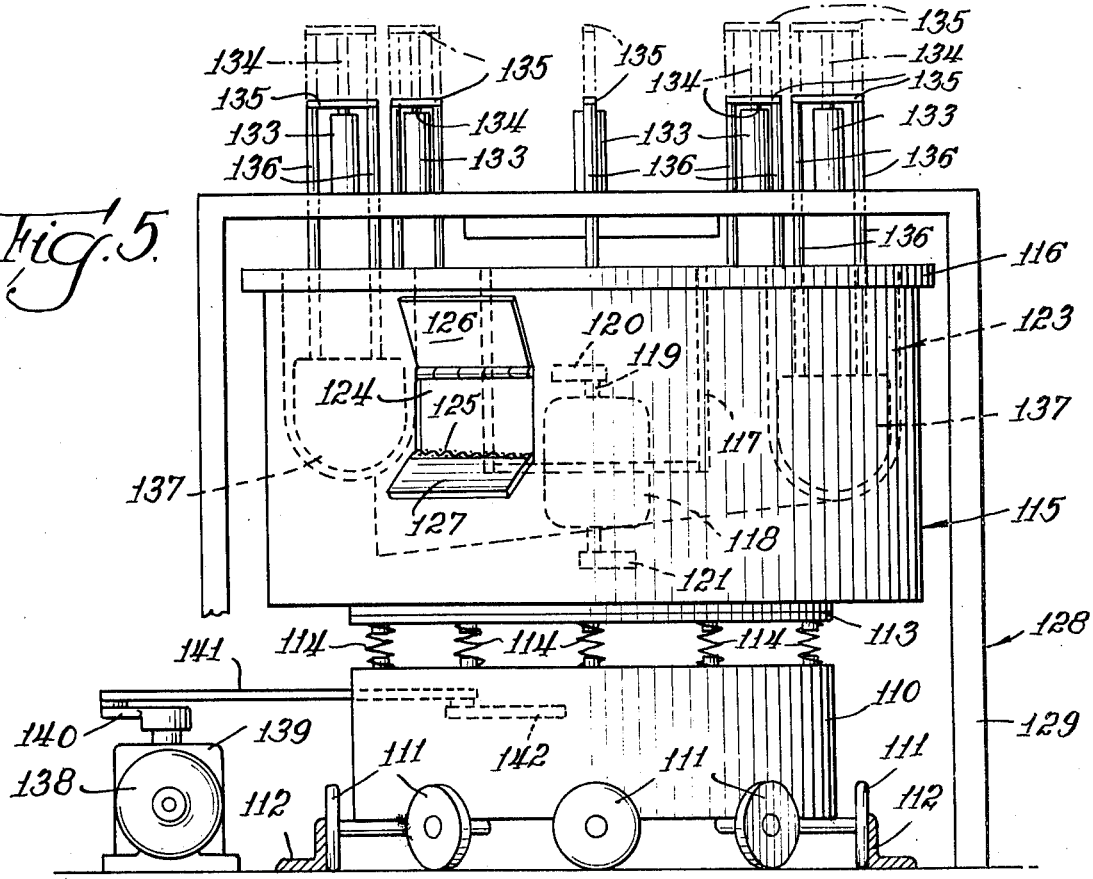
FIG. 5 is an elevational view of the apparatus shown in FIG. 4.

Referring to FIGS. 4 and 5, another embodiment of the invention is shown in the form of a finishing machine in which reciprocating motion is applied to the finishing chamber assembly, while the partitions remain stationary with regard to linear or circumferential motion. The apparatus comprises a base 110 mounted on wheels 111 restrained by an angular track 112. A base plate 113 is resiliently mounted on the base 110 by means of helical springs 114. A tubular finishing chamber support 115 is mounted on the base plate, and provided with a tubular rim 116 at its upper edge. A motor support 117 supports a motor 118 of the unbalanced type having a shaft 119 supporting unbalance weights 120 and 121 arranged out of phase with each other to provide gyratory motion.

The tubular support 115 supports a finishing chamber 123 having a bottom which is arcuate in cross-section and which is circumferentially in the form of a helix having a single turn, the starting portion of the chamber being at the lower part of the helix and the discharge portion being at the upper part of the helix. The discharge portion of the finishing chamber is provided with a separation screen 125 and a discharge port 124 having closure doors 126 and 127.

The part separation means comprises a supporting frame 128 formed of vertical support bars 129 and horizontal support bars 130. Mounted on the frame 128 are diagonal supporting arms 131 and bisecting supporting arms 132. The diagonal support arms and bisecting support arms have a plurality of solenoids 133 mounted thereon, each having an operating shaft 134. The operating shafts 134 are affixed at their ends to transverse arms 135 which in turn are each affixed at their ends to the ends of a pair of vertical shafts 136 slidably journaled through apertured bearings provided in the diagonal and bisecting support arms. At the lower end of each pair of vertical shafts 136 is a partition 137 which is disposed within the finishing chamber 123.

The finishing chamber assembly is provided with reciprocating circumferential motion by means of a motor 138 connected to a speed reducer 139 having a crank 140 operated thereby. The end of the crank is pivotally connected to a connecting rod 141 which in turn is pivotally connected at its other end to an arm 142 connected to the base 110.

In placing the embodiments of FIGS. 4 and 5 into operation, the finishing material is placed in the finishing chamber 123 and the parts are placed in the chamber with adjacent parts separated by the partitions 137. The motor 118 is started, the eccentric weights 120 and 121 causing the motor and the finishing chamber and its support to vibrate with gyrational motion, thereby causing the parts to be finished. Additionally, the gyrational motion is so arranged that the parts and finishing media move longitudinally along the finishing chamber. Additionally, the motor 138 is turned on, which, through the speed reducer 139, causes the crank 140 to revolve about its shaft and to drive the connecting rod 141. The connecting rod 141 operates on the arm 142 causing the base 110 to reciprocate with angular motion. The motor 138 is so timed that the base rotates at substantially the same speed as the parts normally move along the finishing chamber by precession. Alternatively the base 110 may be made to move less rapidly or more rapidly than the parts in order to control the finishing cycle. When the base reaches the end of its movement in a forward direction, the solenoids 133 cause the partitions 137 to be raised to a position high enough so that the parts can pass thereunder. The base 110 is then caused to rotate in a rearward direction with the parts passing under the partitions. When the base reaches its most rearward point, the distance of travel advantageously being arranged so that only one part passes under a partition, the solenoids then permit the partitions to drop and once again to assume a position intermediate the parts, thereby to maintain the parts separated and to prevent damage thereto.

Although the embodiment of FIGS. 4 and 5 has been shown in which the partitions do not revolve within the trough but the trough rotates, in another embodiment (not shown), the solenoids and partitions may be mounted on a turntable, the motor, speed reducer and connecting rod assembly then causing the partition assembly to rotate actively or passively, due to precession of parts and finishing medium, with limited angular movement. Instead of a motor and crank arrangement, a hydraulic cylinder or solenoid may be utilized to provide limited rotation of either the finishing chamber or the partition assembly with respect to each other.

The embodiment of FIGS. 6 and 7 utilizes a finishing chamber and vibratory motion-providing apparatus similar to that shown in FIGS. 1 and 2. The specific portion of the finishing apparatus 151 comprises a finishing chamber 152 of U-shaped cross-section, having either a flat or, preferably, an arcuate bottom, and an elastomeric liner 153. A tubular rim 154 encircles the finishing chamber 152. The finishing chamber assembly is supported by the support plate 155.

The part-separating portion of the apparatus comprises a turntable 156 having a plurality of arms 157 affixed thereto by bolts. A rim 158 is mounted on the arms by means of bolts. A pivot plate 159 is affixed to the rim 158. A connecting rod 160 is pivotally connected to the plate 159 and has a piston rod 161 pivotally connected to the other end, the piston rod forming part of a hydraulic cylinder assembly (not shown).

Mounted on the arms 157 by means of pivot pins 163 are a plurality of partition members 162, pairs of partition members cooperating to define partitions. Limit pins 164 are provided on the partition members to prevent their opening in one direction, while permitting opening in the other direction.

The apparatus is placed in operation in a manner similar to that of the apparatus of FIGS. 1 and 2. The parts are loaded, each part intermediate a pair of partitions. The finishing chamber is caused to undergo gyrational vibration, causing orbital motion and finishing of the parts with finishing material therein. As finishing continues, precession of the parts and finishing material takes place as a result of the particular relationship of the eccentric weights. The hydraulic cylinder assembly operates on the rim 158, causing or passively permitting, by means of normal precession of parts and media, the turntable assembly to rotate in the same direction that the parts move, thereby maintaining the parts in isolated condition with respect to each other. The limit pins 164 cause the partition members to remain in closed position during forward movement. At the end of the predetermined forward travel of the partition assembly, the hydraulic cylinder is caused to reverse. As the partition members 162 encounter the parts, they are opened and permit the parts to pass by. When the hydraulic cylinder assembly has moved the partition assembly rearwardly to its starting position, it reverses and starts the assembly forward, the doors then close and once again define compartments about the parts and keep the parts in isolation. Although not shown, if desired, the partition members may be operated by means of gears or solenoids instead of being permitted to act passively. Additionally, by properly choosing the contouring, the finishing chamber and partitions may be provided with an arcuate bottom to enhance the orbital motion of the finishing material and parts. When desired, the partition members may be spring-loaded into closed position.

Figure 8:
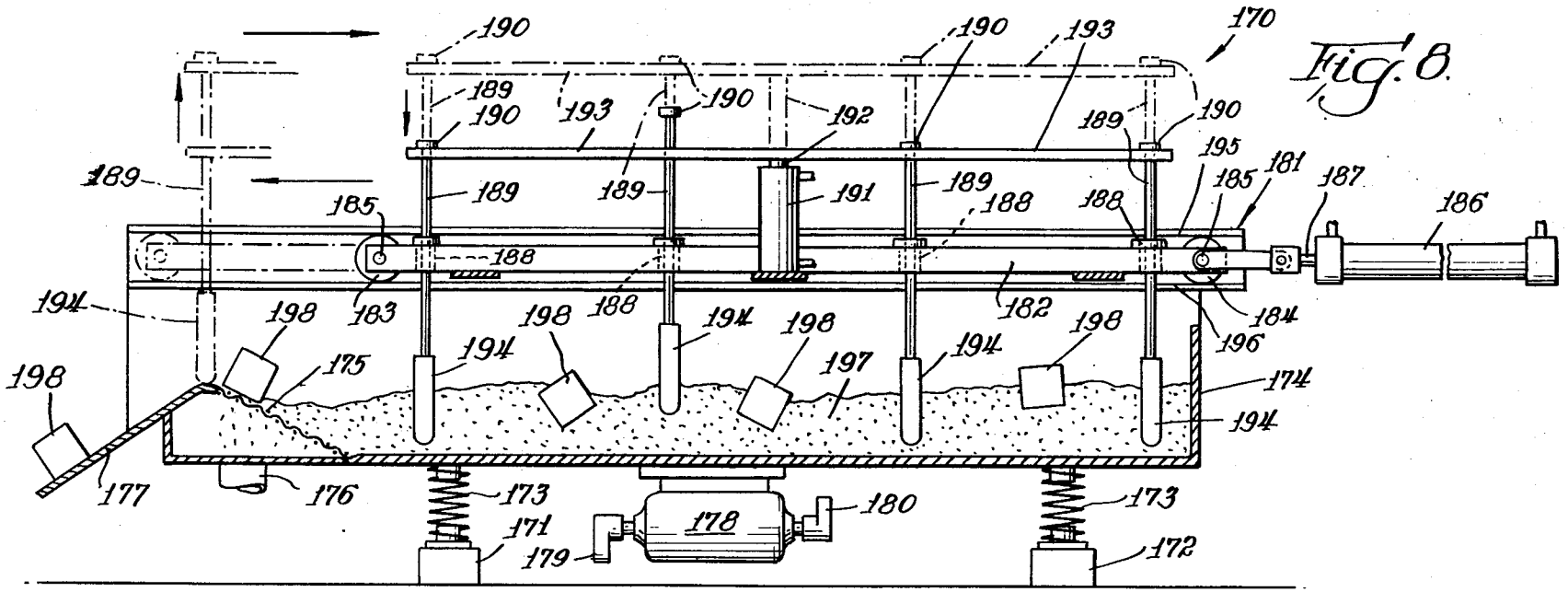
FIG. 8 is a side elevational view of another embodiment of the invention.

Referring to FIG. 8, a finishing apparatus 170 according to another embodiment of the invention is shown. The apparatus is of the linear chamber or tub type, and comprises supports 171 and 172 supporting helical springs 173, which in turn support a linear finishing chamber 174 having a bottom which is arcuate or curvilinear in cross-section. At one end of the chamber 174 is a separation screen 175 arranged to separate finishing material or media from parts to be finished as they both pass over the screen. The separated finishing material passes out of the chamber through a duct 176 and is returned by conventional means to the starting or loading area of the chamber. The separation screen 175 leads to a part discharge ramp 177 for discharging finished parts.

Vibratory motion is imparted to the chamber 174 by means of an electric motor 178 mounted on the bottom of the chamber 174, and having eccentric weights 179 and 180 affixed to the ends of its shaft. The weights are preferably arranged out of phase in order to provide a forward motion to the parts and finishing material to cause them to move from the loading portion of the chamber at one end to the discharge portion of the chamber at the other end.

The reciprocating separating apparatus comprises a channel-form track 181 mounted on the finishing chamber 174. A carriage bar 182 is provided with wheels 183 and 184 which ride in the track 181 and are maintained in position by turned-in flanges 195 and 196 provided on the track 181. The wheels 183 and 184 are mounted on the carriage bar by means of pins 185. The carriage bar 182 is reciprocally driven by means of a hydraulic cylinder 186 operating a piston rod 187 coupled to the carriage bar 182.

A plurality of sleeve bearing inserts 188 are mounted in apertures provided in the carriage bar 182 and have shafts 189 slidably mounted therein. Disc-form end stops 190 are provided at the end of each shaft 189. A hydraulic cylinder 191 is mounted on the finishing chamber 174 having a piston rod 192 affixed to a horizontal lift bar 193. A plurality of rubber-covered partitions 194 are affixed to the lower ends of the shafts 189 and serve the function of maintaining the parts separated from each other to prevent damage due to collision.

To place the apparatus of FIG. 8 in operation, finishing material 197 is placed in the bottom of the chamber. Parts to be finished are then placed in the chamber with the partitions 194 separating the parts 198. The motor 178 is then turned on causing the chamber 174 to undergo gyrational motion, causing the parts to be finished and, additionally, to be moved forward (to the left of the apparatus shown in FIG. 8). The operation of the hydraulic cylinder 186 is timed so that the partitions actively or passively move along with the parts. When the hydraulic cylinder 186 reaches the end of its movement, it stops, and the cylinder 191 is actuated to cause the lift bar 193 to move upwardly. As a result, the partitions 194 are moved upwardly, until they are no longer intermediate the parts 198. While the partitions remain in their upwardmost position, the hydraulic cylinder 186 is caused to retract, to cause the partitions to pass over the parts without engaging them. When the cylinder 186 has reached the limit of retraction, the cylinder 191 is caused to lower the horizontal disc bar 193, until the partitions 194 are once again intermediate the parts and once again maintain the parts isolated from each other. The apparatus then begins another cycle. When the parts reach the screen 175, the gyrational motion causes them to move upward along the screen while the surrounding finishing media passes through the screen and is separated from the parts. The parts eventually reach the discharge ramp 177 and are discharged.

Figure 9:
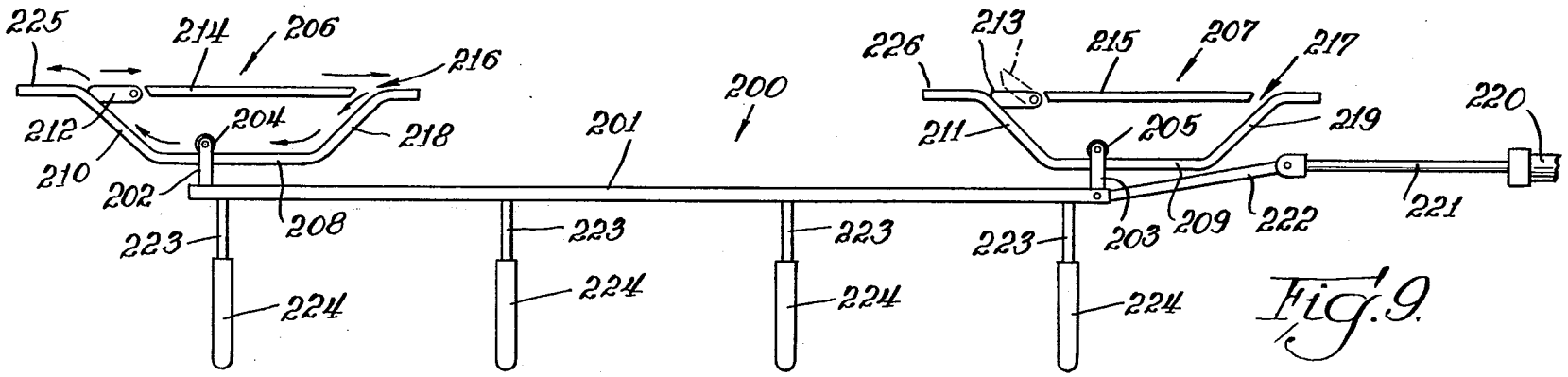
FIG. 9 is a fragmentary side elevational view of another embodiment of the invention.

Referring to FIG. 9, a reciprocating partition assembly 200 is shown, comprising still another embodiment of the invention and is designed to operate with a finishing chamber assembly such as that shown in FIG. 8. The apparatus comprises a carriage bar 201 having support bars 202 and 203 and roller wheels 204 and 205 mounted at the ends thereof. The pair of track assemblies 206 and 207 comprise lower horizontal track members 208 and 209, ascending ramps 210 and 211, and gates 212 and 213 pivotally mounted on upper horizontal track members 214 and 215. Ports 216 and 217 are provided intermediate the ends of the upper horizontal track members 214 and 215 and descending ramps 218 and 219, respectively. A hydraulic cylinder 220 operating by means of a piston rod 221 and a connecting rod 222 drives the carriage bar 201 in reciprocal motion. Support rods 223 are mounted on the carriage bar 201 and have rubber-covered partitions 224 mounted at the ends thereof.

The reciprocating partition assembly of FIG. 9 is mounted on a finishing machine in a manner similar to that shown in FIG. 8. When the motor is started and the finishing chamber undergoes gyratory motion, the parts move in an orbital motion and also in a forward motion. Additionally, the hydraulic cylinder 220 is actuated and causes the carriage bar 201 to move forward, either actively or passively, thereby causing or permitting the partitions 224 to move forward as the parts also move forward. The roller wheels 204 and 205 ride on the lower horizontal track members 208 and 209 for a major portion of forward travel. When the roller wheels reach the ascending ramps 210 and 211, they cause the partitions to rise. The carriage bar 201 continues to move forward until the roller wheels 204 and 205 reach the gates 212 and 213 and push them open, continuing until they reach the forward portions 225 and 226 of the upper track members. The gates 212 and 213 then close behind the roller wheels. The hydraulic cylinder 220 then retracts and causes the carriage bar 201 to move rearwardly, the roller wheels 204 and 205 riding on the upper horizontal track members 214 and 215 while maintaining the partitions 224 raised above the parts. When the hydraulic cylinder reaches its rearwardmost limit and begins to move forward again, the roller wheels 204 and 205 pass through the ports 216 and 217, descend the ramps 218 and 219 and once again lower the partitions until they assume their position intermediate the parts.

The finishing apparatus of the present invention having reciprocating means for separating parts has several advantages over prior art finishing machines. First, the apparatus maintains parts to be finished physically separated from each other to prevent damage to the parts, such as breakage, denting, or scratching, which might result if the parts were permitted to collide with one another. Because the separating apparatus is designed to operate in reciprocating manner, it can be made much simpler, more foolproof, and less expensive than apparatus wherein the separating device is required to travel completely around the finishing chamber or, in the case of a linear finishing chamber, along the entire length of the finishing chamber. The reciprocating type machine may be made in many forms and embodiments, some of which have been described and illustrated in the specification and drawings. Additionally, many variations of the embodiments shown and described may be designed by those skilled in the art, and are to be considered as part of the present invention. The apparatus of the invention is also superior in the respect that it may be utilized with finishing apparatus of many kinds, such as linear, annular, helical, et cetera.

In addition, the apparatus and method of the invention are also superior in the respect that they permit and in fact are designed to allow the advantage of passive movement of the parts-isolating means at the speed of precession of the mixture of parts being finished and finishing media, so as not to interfere with the normal rate of precession of the mass along the finishing chamber, or, if desired, to be able to retard the rate of precession somewhat so as to ensure adequate dwell-time of parts and media within the finishing chamber. However, the apparatus of the invention consumes no more floor space than the normal finishing machine itself, does not require attendants to pluck parts from an end or any area of the finishing machine at the end of a finishing cycle, and does not of necessity continuously drive parts, thereby causing pile-ups and impingement of parts upon each other and upon the parts-isolating means and in the corners of the finishing chamber when a linear finishing chamber is involved, with attendant nicking and disruption of the continuity of the finishing process. Additional advantages are that an attendant is not required for placement of parts between parts-separating means or affixing them to or between the same, or for removal of the parts from such a fixed position. Numerous other additional advantages will immediately be apparent to one skilled in the art.

It is to be understood that the invention is not to be limited to the exact details of operation or structure shown and described, as obvious modifications and equivalents will be apparent to one skilled in the art.

I claim:

1. A finishing machine suitable for finishing the surfaces of a plurality of parts with finishing material while maintaining said parts isolated from each other to prevent damage to said parts as a result of collision therebetween, and then separating finished parts, said finishing machine comprising:

1. a finishing chamber, 2. means for imparting movement to said finishing chamber to cause the parts contained therein to be finished by interaction with said finishing material,
3. part-isolating means defining at least one compartment in said finishing chamber arranged to contain a part or parts therein and to maintain said part or parts isolated from other parts in said finishing chamber,
4. reciprocating means comprising (a) means arranged for moving or permitting movement of said part-isolating means and said finishing chamber with respect to each other in a first direction for a limited distance while said part-isolating means are arranged in positions intermediate said parts for isolating said parts, (b) means arranged for moving said part-isolating means from said positions intermediate said parts to new positions not intermediate said parts to permit said part-isolating means and said parts to move past one another, (c) means arranged for moving said part-isolating means and said finishing chamber with respect to each other in a second direction in reverse relationship to said first direction, and (d) means arranged for returning said part-isolating means to positions which are intermediate said parts,
5. part-separating means operatively associated with said finishing chamber for separating finished parts from finishing material in a separating zone, and
6. said part-separating means, said finishing chamber, and said part-isolating means being arranged with respect to each other so as to permit individual separation of the part or parts isolated in a compartment defined by said part-isolating means when said compartment is in said separation zone.

2. A finishing machine according to claim 1, wherein said part-isolating means comprises a support mounted for movement with respect to said finishing chamber, and a plurality of partitions mounted on said support, said support being arranged to actively or passively guide said partitions along said finishing chamber.

3. A finishing machine according to claim 2, wherein said finishing chamber is annular and said partitions are mounted on a turntable.

4. A finishing chamber according to claim 3, wherein said partitions are hingedly mounted along an upper portion thereof on a substantially horizontal axis, said partitions being arranged to rise over said parts when said part-isolating means and said finishing chamber are moving in said second direction with respect to each other, and having means for maintaining said partitions in a vertical position when said part-isolating means and said finishing chamber are moving in said first direction with respect to each other.

5. A finishing machine according to claim 2, wherein said partitions are arranged to be raised vertically in order to remove them from their positions intermediate said parts, and to be lowered vertically in order to return said partitions to positions which are intermediate said parts.

6. A finishing machine according to claim 5, wherein said partitions are raised and lowered by means of solenoids.

7. A finishing machine according to claim 3, wherein each partition comprises a pair of partition members, each pivotally mounted along a vertical axis at its outer edge and cooperating to open and close as a pair of gates.

8. A finishing machine according to claim 1, wherein said finishing chamber is in the form of a linear trough, and said part-isolating means comprises a plurality of vertical positions, a horizontal carriage mounted for reciprocal movement along said finishing chamber, a solenoid mounted on said carriage, a horizontal support bar connected to one end of said solenoid, and a plurality of partitions mounted on shafts supported on said horizontal support bar, whereby actuation of said solenoid alternately lowers said partitions to positions intermediate said parts and raises them to positions in which said partitions are not intermediate said parts.

9. A finishing machine according to claim 2, wherein said finishing chamber is in the form of a linear trough, and said reciprocating means comprises a horizontal bar having said part-isolating means in the form of partitions mounted thereon, means supporting said horizontal bar and having a pulley thereon mounted on a track, said track being arranged to permit said pulley to travel for said first limited distance while said partitions are intermediate said parts, an upwardly inclined portion for raising said partitions to an elevated position in which said partitions are not intermediate said parts, a second horizontal portion for permitting said partitions to move in said second direction at an elevated position, and a second ramp downwardly directed for lowering said partitions to their positions intermediate said parts.

10. A finishing machine according to claim 1, wherein said means for imparting movement to said finishing chamber is a gyratory motion-producing assembly resiliently supported for gyrational motion, and said finishing chamber is a substantially horizontally oriented annular trough operatively affixed to said gyratory motion-producing assembly.

11. A finishing machine according to claim 1, wherein the compartment defined by said part-isolating means is moveable with respect to said separation zone.

12. A finishing chamber according to claim 1, wherein said finishing chamber and separation zone are moveable with respect to said compartment defined by said part-isolating means.

13. A finishing machine according to claim 1, wherein said means for separating finished parts comprises a ramp for raising said parts and finishing material, and a screen for separating said finishing material, said means arranged to conduct said parts to a discharge exit.

* * * * *